US006641439B2

(12) United States Patent
Kim

(10) Patent No.: US 6,641,439 B2
(45) Date of Patent: Nov. 4, 2003

(54) D-SUBCONNECTOR PROVIDED WITH FERRITE CORES

(75) Inventor: Yongup Kim, Seoul (KR)

(73) Assignees: Viewtech IC Co., Ltd., Seoul (KR); Ilhwan Lee, Seoul (KR)

( * ) Notice: Subject to any disclaimer, the term of this patent is extended or adjusted under 35 U.S.C. 154(b) by 42 days.

(21) Appl. No.: 09/946,685

(22) Filed: Sep. 6, 2001

(65) Prior Publication Data

US 2002/0031946 A1 Mar. 14, 2002

(30) Foreign Application Priority Data

Sep. 8, 2000 (KR) ..... UM2000-25669

(51) Int. Cl.[7] ..... H01R 13/66
(52) U.S. Cl. ..... 439/620; 439/608
(58) Field of Search ..... 439/620, 108, 439/608, 609, 607

(56) References Cited

U.S. PATENT DOCUMENTS 5,340,334 A * 8/1994 Nguyen ..... 439/620
5,605,477 A * 2/1997 Wu et al. ..... 439/620

FOREIGN PATENT DOCUMENTS

KR 1996-0007460 8/1996
KR 1999-0038544 10/1999

* cited by examiner

*Primary Examiner*—Khiem Nguyen
(74) *Attorney, Agent, or Firm*—Greenblum & Bernstein, P.L.C.

(57) ABSTRACT

The present invention relates to a D-subconnector provided with ferrite cores, formed in the opposite ends of a computer signal cable which connects to a computer body and a monitor. More particularly the plurality of ferrite cores are incorporated in an interior of the D-subconnector, and a copper plate is inserted between the cores. This configuration substantially attenuating magnetizing action. Additionally, the copper plate can achieve common grounding inside the D-subconnector. Moreover, the present invention can obtain an E.M.I. effect while obtaining clearer images and reducing the occurrence of a short-circuit.

6 Claims, 5 Drawing Sheets

D-SUBCONNECTOR PROVIDED WITH FERRITE CORES

BACKGROUND OF THE INVENTION

1. Field of the Invention

The present invention relates to a D-subconnector provided with ferrite cores, formed in the opposite ends of a computer signal cable which connects a computer and a monitor, particularly to a D-subconnector provided with ferrite cores, wherein a plurality of ferrite cores are incorporated in an interior of the D-subconnector, and a copper plate of non-magnetic substance is inserted between the cores.

2. Background of the Related Art

The cable for a computer used in the prior art has had an ungainly appearances because a cylindrical ferrite core 30 is dangled from a cable on the outside of the cable and it is clad molded with a synthetic resin, for a measure of the electromagnetic wave interference as shown in FIG. 1 and FIG. 2. And in case of the cable being placed at the rear of the computer body, it usually requires a certain space at the rear of the body because the cable is not bend smoothly due to the core fixed at the cable.

Accordingly, to solve the problems of the above mentioned devices, the present inventor formally has filed a utility model (Korean Utility Model Application numbers 93-28350 and 98-4627), and the present invention improves and develops the former models, the effect and manufacturing process of which being better than the former models.

The details of the formerly filed models are as follows. First, the model (refer to FIG. 3) which is to improve the resolution is to obtain an E.M.I. effect without giving influence on the resolution of the monitor by improving the rise time and the fall time of a video color signal controlling the resolution of the monitor, with eliminating the variations of impedance value influenced on account of the ferrite core, by forming a pin hole 10 penetrating each other in incorporation a red hole and a red ground hole, green hole and a green ground hole, and a blue hole and a blue ground hole.

However, the former models have some problems with exhibiting a suitable effect because only one ferrite core is provided, and the thickness of the ferrite core is as large as 6 mm. Even though the ferrite core has a much superior effect compared with the prior art as shown in FIG. 2, it has considerably inferior effect compared with the present invention wherein a plurality of ferrite cores are provided after being divided into two parts to make the thickness of the core thinner than that of the prior art by ½, and a copper plate of nonmagnetic substance is inserted between the cores.

Also, a model (refer to FIG. 4) which is designed to improve workability can easily ground a plurality of terminals of lead wires, by preparing a thin connecting material 100 of good conductivity and inserting it between the pin holes to be grounded, for more effective groundings, so that the workability is far superior to that of the prior art wherein three connecting terminals of lead wires are welded one by one to the pin holes having diameters of merely 0.7 mm. However, the model also has a problem with inserting the connecting material into the gap between the pin holes because the gap is too narrow to be inserted easily.

SUMMARY OF THE INVENTION

The present invention relates to a D-subconnector provided with ferrite cores, formed in opposite ends of a computer signal cable which connects a computer and a monitor, particularly to a D-subconnector provided with ferrite cores, wherein a plurality of ferrite cores are incorporated in the interior of the D-subconnector, and a copper plate of non-magnetic substance is inserted between the cores.

The plurality of ferrite cores which are incorporated in the interior of the D-subconnector of the present invention make the thickness of the core thinner than that of the prior art by ½, and a copper plate of nonmagnetic substance attenuating magnetizing action is inserted between the cores, thus attenuating magnetizing action all the more. In addition, by using the copper plate, the common grounding can be carried out inside the D-subconnector, thus obtaining twofold effects of maximizing workability than that of the prior art. Moreover, the present invention can obtain an E.M.I. effect with less influence on resolution than that of the prior art, thus obtaining clear images, as well as preventing a short-circuit or an implosion, resulting in greatly reduced defective rate.

DETAILED DESCRIPTION OF THE PREFERRED EMBODIMENTS

Figure 1:
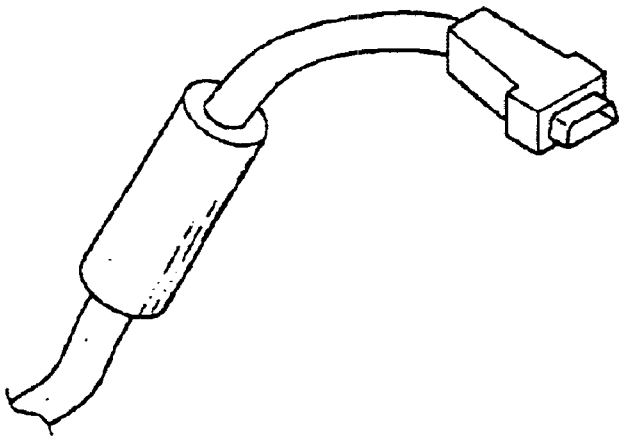
FIG. 1 PRIOR ART
FIG. 1 is a perspective view showing a cable on the prior art with a ferrite core provided.
Figure 2:
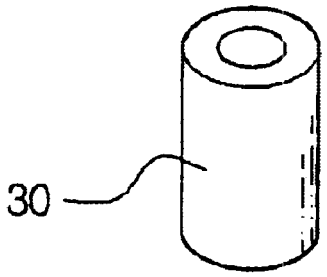
Fig. 2 PRIOR ART
FIG. 2 is a perspective view showing a ferrite core of the prior art.

A D-subconnector provided with ferrite cores, the ferrite cores are formed with at least three sets of pin holes 10, a set of which comprising two incorporated pin holes, a fixed plate 5 formed with a plurality of pin holes 9 to be inserted by a plurality of connecting pins 4, ferrite cores, and insulator 3 being provided into metal shells 1, 2, wherein a plurality of ferrite cores 6, 7 are provided in the interior of the D-subconnector, a copper plate 8 formed with a plurality of pin holes is inserted between the ferrite cores 6, 7, and a bent ground part 8' is provided with in one side of the copper plate 8, and the ground part 8' is grounded to metal shell 2.

The diameters of the pin holes formed in the copper plate 8 are made different from one another, in such a manner that the diameters of the pin holes 9' are small to be able to contact with the pins 4, while the diameters of the pin holes 9" are larger than that of the pins so as not to contact with the pins.

Next, the details of the present invention having such a construction will be described.

Figure 3:
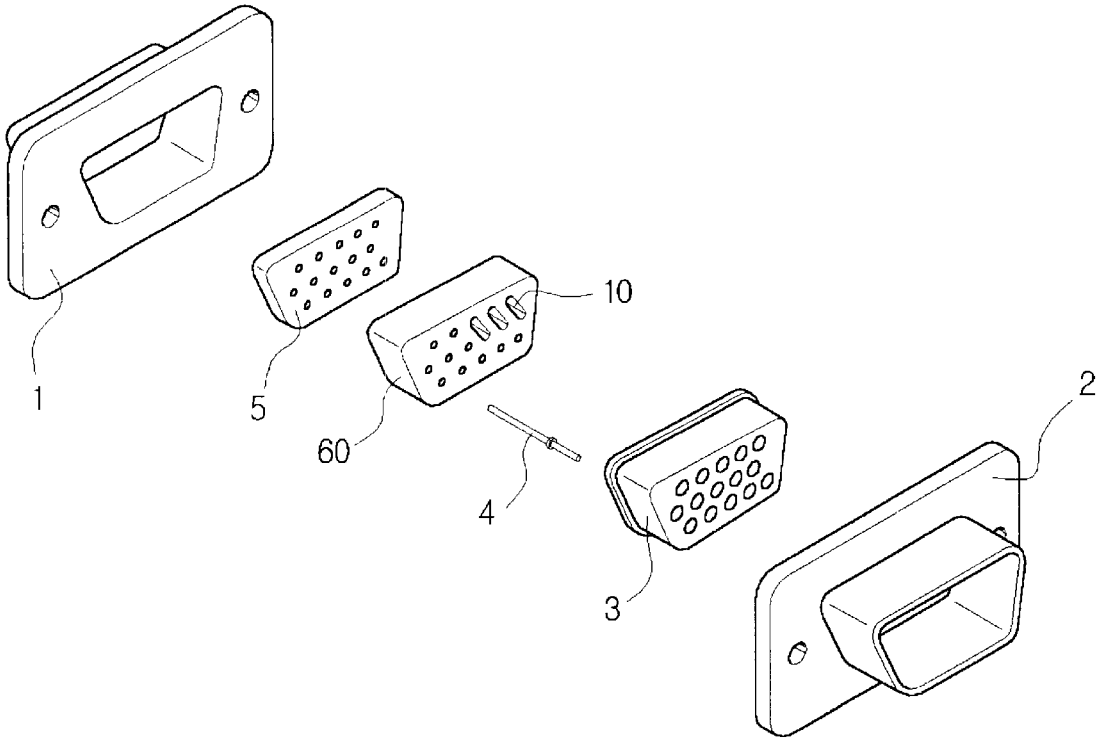
FIG. 3 is a breakdown perspective view showing a utility model, file numbers 93-28350, formally filed by the present inventor.
Figure 4:
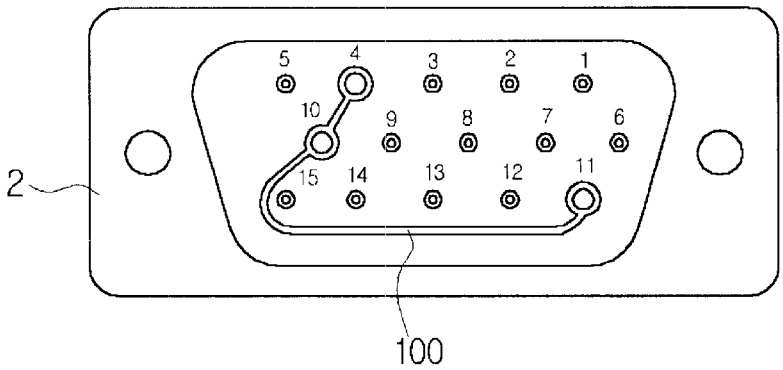
FIG. 4 is a rear view showing a D-subconnector terminal attached with a connecting material, which is an essential part in a utility model, file numbers 98-4627, formally filed by the present inventor.
Figure 5:
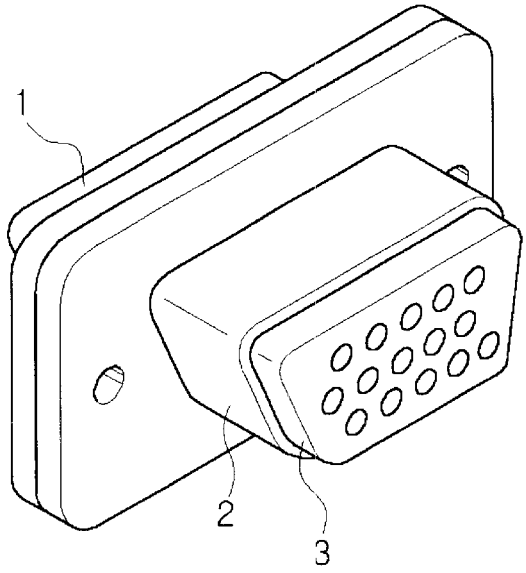
FIG. 5 is a perspective view showing a D-subconnector of the present invention.
Figure 6:
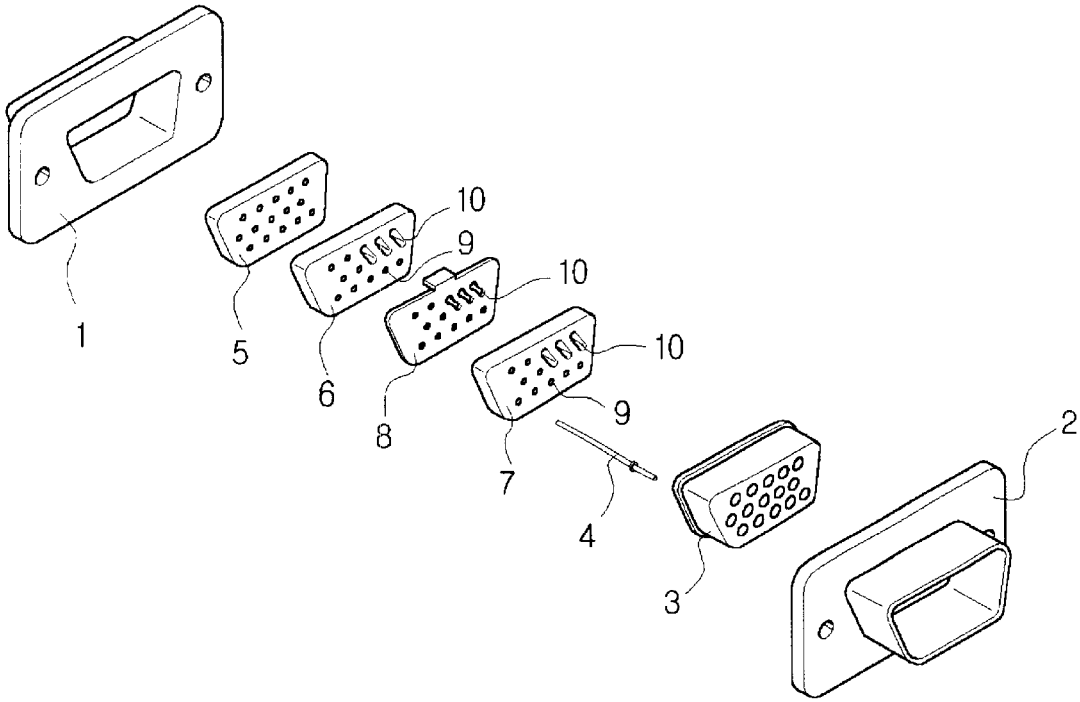
FIG. 6 is a breakdown perspective view showing a D-subconnector of the present invention.
Figure 7:
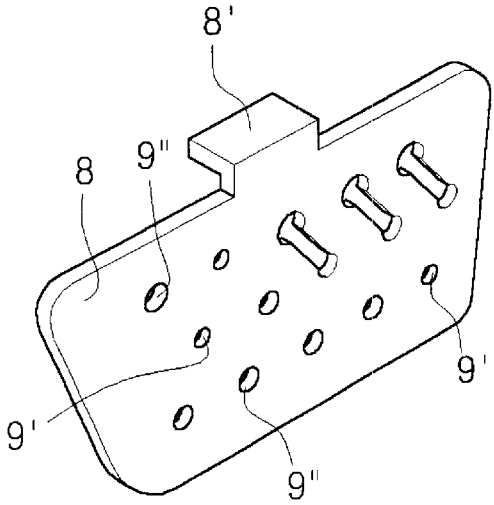
FIG. 7 is a perspective view showing a copper plate, which is an essential part of the present invention.
Figure 8:
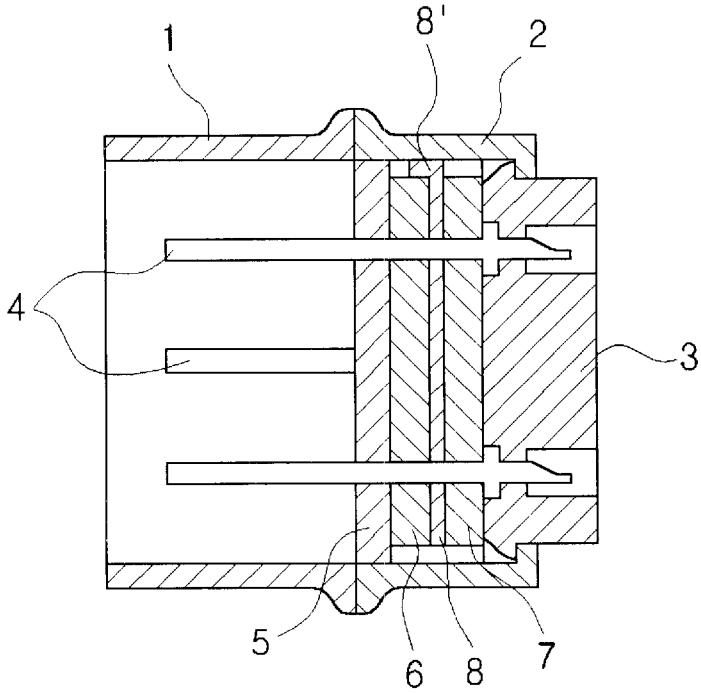
FIG. 8 is a sectional view showing a D-subconnector of the present invention.

The operating effects of the formerly filed model by the present inventor wherein contact pins are formed in one ferrite core are as follows (refer to FIG. 3).

In the ferrite core 60 provided in a D-subconnector, a plurality of pin holes to be inserted by contact pins are formed, and the pin holes include pin holes 9 to be inserted by single pins 9 and pin holes 10 to be inserted by a plurality of pin holes, pin holes 10 being the ones to pass R.G.B. signals which are video color signals. Typically, as R.G.B. signals, i.e., color signals of a computer are transmitted through coaxial cables, the coaxial lines are comprised of ground lines, when the lines are inserted into each of the pin holes, the inductance induced becomes twofold, resulting in a time delay in the induced part. This time delay, in case of a color brown tube, causes a deviation of electrons, which pass through the shadow masks, to become a deviation of chromaticity, resulting in an insufficient signal reproduction.

However, in the ferrite core, if the pin holes are connected through each other extendedly, inductances are offset magnetically in the process of passing through to and fro, thus being made zero so as not to cause a time delay. Next, a more detailed description will be follow.

Figure 9:
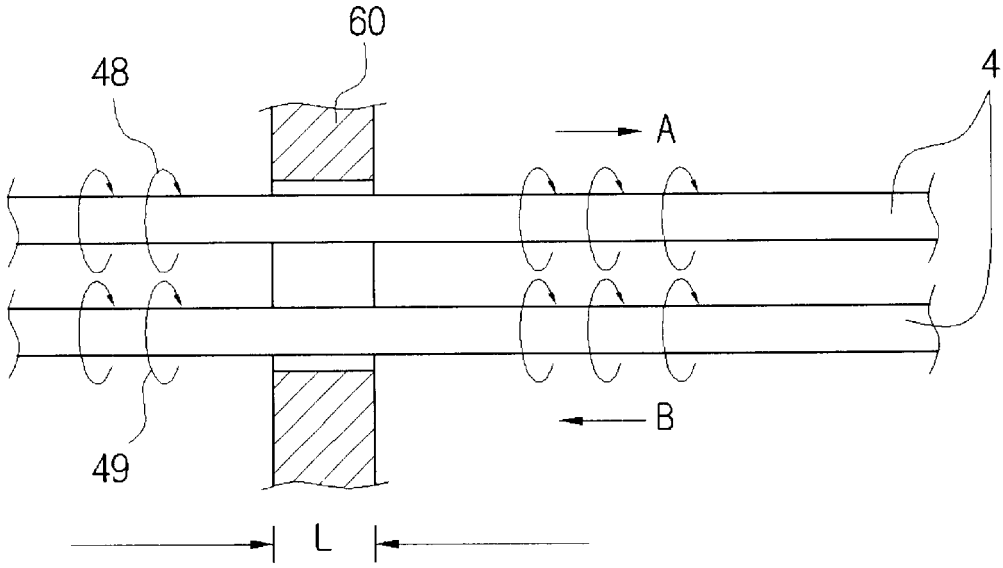
FIG. 9 is a detailed diagram showing an inductance during a connecting pin is passing through a ferrite core.

FIG. 9 shows an offset effect of inductance by contact pins passing through the ferrite core, wherein two contact pins pass through the pin holes of the ferrite core in parallel. When a signal current of one direction flows in the contact pin as shown by arrow A, a signal current in the opposite direction flows in the contact pin as shown by arrow B. Accordingly, lines of magnetic force are induced around this contact pin as shown in 48 and 49. When the lines of magnetic force 48 turn to the right, the lines of magnetic force 49 turn to the opposite direction. The lines of magnetic force in a portion of distance L surrounded by magnetic substance of the ferrite core become zero as a result of offsetting of positive (+) and negative (−) forces. Accordingly, in the interior of the pin hole 10, the inductances are offset from each other, thus becoming zero. Accordingly, a time delay does not occur because of no inductance element, as well as a noise of high frequency is prevented. As there is no time delay, when images are reproduced on a CRT, clear images having resolutions not influenced by the deviation of chromaticity can be obtained on the CRT.

That is, by penetrating each other in incorporation a red hole and a red ground hole, green hole and a green ground hole, and a blue hole and a blue ground hole, the element of the inductance value becomes zero, and the time delay of the rise time and fall time of the video color signal which controls the resolution of a monitor does not occur, to the effect that not only give no influence on the resolution, but also gain a large E.M.I. effect.

However, if the pin is made to pass after the ferrite core is provided with being divided into a plurality of parts so as to make the thickness of the core thinner than that of the prior art by ½, and a copper plate is inserted between the ferrite cores, it is able to attenuate the magnetizing action all the more, thus enabling clear images having the resolution not influenced than that of the prior art appear on a CRT.

The thickness of the ferrite core provided in the D-subconnector formally model-filed by the present inventor was generally 6 mm, but in the present invention, the plurality of ferrite cores of the thickness of around 2 mm or 3 mm are folded, while a copper plate is inserted between the cores. Accordingly the model is better in an attenuating effect of the magnetizing action, thus giving less influence on the resolution than that of the prior art. Typically, the larger the size of a ferrite core, the stronger the magnetizing force becomes. Accordingly, the ferrite core of the present invention has a smaller size than that of the prior art by half, making the induction of the magnetizing action less. Particularly, the ferrite core occurs fissures due to the high temperature in the process of an intense heat and weakening the magnetic action all the more, so that the chromaticity signal could be sent without any loss. In addition, a copper plate is inserted between the cores, attenuating the magnetizing action all the more. Also, in the present invention, the copper plate can be connected to the terminals of lead wires in the interior of the D-subconnector, as well as weakens the magnetizing action, whereas in the formally filed models, only the pin holes to be grounded are grounded between pin holes using wires having good conductivity, but making its workability difficult because of excessive narrowness of the gap between pin holes.

However, in the present invention, a copper plate of nonmagnetic substance formed with a plurality of pin holes (usually 15 holes) so as to pass all pins through is inserted between the ferrite cores, and the diameters of the pin holes 9' through which the pins to be grounded pass are made smaller so as to be able to contact the pins, while the diameters of the pin holes 9" through which the pins not to be grounded pass are made larger than the ones of the pins, thus only the pins to be grounded can be grounded to the copper plate very easily.

As described above, the present invention can carry out the work of common grounding using a copper plate very easily, so that the entire workability can be maximized. In addition, as the terminals of lead wires can be grounded in common in the interior of the D-subconnector, a short-circuit or implosion can be prevented perfectly, resulting in greatly reducing a defective rate compared with that of the prior art.

When the pins contact the pin holes of the copper plate, the contact portion is welded to contact more firmly. The thickness of the copper plate is preferably about 0.3 mm□0.4 mm, and the material of the plate can be any substance such as silver and aluminum so far as it has a good conductivity. The purpose is to ground the grounding holes easily as well as to attenuate the magnetizing effect, the grounding can be easily performed if the grounding unit 8' is provided in some portion on one side of the copper plate and is bent to contact to the metal shell.

The cable of the prior art has had an ungainly appearance because a ferrite core is dangled from a cable. However, as in the present invention, if ferrite cores are provided in the interior of a D-subconnector, its appearance becomes more simple. The ferrite core of the present invention can be used in all kinds of monitors, especially used very suitably in a LCD monitor, which is growing rapidly following the sense of the times.

In the present invention, a plurality of ferrite cores are provided in the interior of a D-subconnector, and a copper plate is inserted between the cores, the ferrite cores being divided into two parts to make the thickness of the core thinner than that of the prior art by ½, and the copper plate being made of nonmagnetic substance to attenuate the magnetizing action. Accordingly, the present invention can weaken the magnetizing action more greatly than that of the prior art wherein a larger size of one ferrite core provided. Also, when a ferrite core is produced, as it needs to be subjected to a plastic process of an intense heat, fissures are likely to form on tissue of the core surface, weakening the magnetizing action all the more. In addition, as the copper plate can be worked for common grounding in the interior of the D-subconnector, as well as can attenuate the magnetizing action, it has a double effect of maximizing the workability compared with that of the prior art, and can get an E.M.I. effect without giving an influence on the resolution, thus obtaining clear images. Besides, a short-circuit or implosion can be prevented more often, resulting in a reduced defective rate greatly compared with that of the prior art and its effect is very excellent.

What is claimed is:

1. A D-subconnector comprising:

a plurality of ferrite cores having at least three sets of pin holes, at least one set of the pin holes comprising two connected pin holes;

a fixed plate having a plurality of pin holes configured to receive a plurality of connecting pins; and a plurality of metal shells that hold said plurality of ferrite cores and an insulator, wherein said plurality of ferrite cores are provided in an interior of the D-subconnector, a copper plate having a plurality of pin holes is provided between said ferrite cores, and said copper plate having a bent ground part on one side that is grounded to at least one of said metal shells.

2. The D-subconnector of according claim 1, wherein the diameters of the pin holes in said copper plate are at least one of a first size and second size, said first size pin holes contact the connecting pins and the second size pin holes do not contact the connecting pins.

3. The D-subconnector of according claim 1, said plurality of ferrite cores being between said fixed plate and said insulator.

4. The D-subconnector of according claim 2, said plurality of ferrite cores being between said fixed plate and said insulator.

5. A cable with a D-subconnector comprising:

a plurality of ferrite cores having at least three sets of pin holes, at least one set of the pin holes having two connected pin holes;

a fixed plate having a plurality of pin holes configured to receive a plurality of connecting pins; and a plurality of metal shells that hold said plurality of ferrite cores, a copper plate, and an insulator, wherein diameters of pin holes formed in said copper plate are at least one of a first size and second size, said first size pin holes contacting the connecting pins and the second size pin holes not contacting the connecting pins.

6. The D-subconnector of according claim 5, said plurality of ferrite cores being between said fixed plate and said insulator.

* * * * *